United States Patent [19]

Kelley

[11] 4,183,365

[45] Jan. 15, 1980

[54] WATER PIPE OR BONG

[76] Inventor: Scott A. Kelley, P.O. Box 7181, Odessa, Tex. 79760

[21] Appl. No.: 836,424

[22] Filed: Sep. 26, 1977

[51] Int. Cl.[2] ..... A24F 1/26; A24F 1/30

[52] U.S. Cl. ..... 131/180; 131/173

[58] Field of Search ..... 131/173, 180, 178, 171, 131/205, 224

[56] References Cited

U.S. PATENT DOCUMENTS

| | | | |
|---|---|---|---|
| 682,278 | 9/1901 | Roller | 131/180 X |
| 1,302,047 | 4/1919 | Hurst | 131/180 |
| 1,864,400 | 6/1932 | Berger | 131/180 |
| 4,044,781 | 8/1977 | Heggestuen | 131/180 |

*Primary Examiner*—Stephen C. Pellegrino
*Attorney, Agent, or Firm*—Marcus L. Bates

[57] ABSTRACT

A water pipe or bong for smoking tobacco comprising a base to which there is affixed one end of an upright, hollow cylinder, thereby leaving an open end which can be received against one's mouth so that smoke can be inhaled by applying a suction action to the interior of the cylinder. A revolver is axially aligned with the longitudinal centerline of the hollow cylinder with the cylinder being telescopingly received within the revolver and with the revolver being rotatably positioned about a medial portion of the cylinder. A plurality of radially spaced combustion chambers are formed within the revolver in which tobacco can be stored and combusted. The combustion chambers include an open end into which tobacco is charged and an outlet end through which smoke can flow. A passageway is formed between the outlet of the combustion chamber and the interior of the hollow cylinder so that air can be drawn into the combustion chamber, thereby burning the tobacco, so that smoke flows through the outlet into the interior of the chamber and into one's mouth.

7 Claims, 5 Drawing Figures

WATER PIPE OR BONG

BACKGROUND OF THE INVENTION

Tobacco smoking is a known health hazard and the Attorney General has consistently warned the public of its dangers over the past several years. Teenagers and college students have resorted to smoking other tobacco-like products including herbs, dried lettuce, and various other materials having a consistency and texture similar to tobacco and also having questionable effects upon one's health.

It is well known and established that a pipe is much safer for a smoker as compared to a cigarette or a cigar. The incidence of lung cancer associated with a pipe is much lower than that associated with cigarettes. However, a habitual pipe smoker sometimes continuously keeps his pipe in his mouth whether it is lit and in use or dormant. This produces cancer of the lips and is, of course a very undesirable feature of pipe smoking. Moreover, a pipe is convenient to carry about in one's pocket and therefore is a constant reminder which prods the smoker into excessive use thereof.

The combustion chamber of a pipe usually contains a substantial amount of tobacco, which initially serves as a filter, but as tar and other products of combustion deposit upon the unburned tobacco, they are subsequently ignited and burned. The combustion of these undesirable tar and other untold different types of chemicals are subjected to extremely high temperatures; and accordingly, the molecules are cracked by thermal decomposition, thereby releasing unknown quantities of different hazardous chemicals which are ingested into the lungs. Furthermore, ashes and other debris are pulled into one's mouth while smoking a pipe.

Pipe smokers sometime allow moisture or saliva to collect into the bottom of the pipe bowl, which results in a repulsive gurgling noise and if the pipe smoker attempts to clean this nauseating matter from his pipe, his associates are subjected to a highly unsanitary and repulsive scene.

Accordingly, it it desirable to have made available apparatus for smoking tobacco and other substances which avoids some of the unsanitary and unsightly conditions associated with an ordinary smoking pipe. It is further more desirable to have available an apparatus for smoking which enables the smoke to cool before it is ingested in one's mouth, and which allows entrained particles to settle out or to be removed before the smoke is inhaled. Moreover, it is desirable to make available a plurality of charges of tobacco so that a new fresh charge of tobacco can be conveniently ignited without the inconvenience of interrupting the pleasures of smoking while the apparatus is being refilled.

PRIOR ART

Hurst U.S. Pat. No. 1,302,047; Roller U.S. Pat. No. 682,278; Dall U.S. Pat. No. 1,578,810; and Mochizuki U.S. Pat. No. 2,216,087 each teach a smoking pipe having a plurality of combustion chambers associated therewith so that when the tobacco in one chamber has been consumed, the tobacco in a remaining chamber can be ignited. Halaby U.S. Pat. No. 3,765,426 also teaches a pipe having a plurality of tobacco containing chambers which may be selectively ignited as may be desired.

Berger U.S. Pat. No. 1,864,400 discloses a smoker's appliance having a plurality of tobacco containing enclosures associated therewith, while McFadden U.S. Pat. No. 3,881,499 discloses a water pipe or bong which includes an array of tubes which causes the smoke to be drawn through the water.

None of the above cited art discloses a smoking appliance in the form of an upright, hollow cylinder about which there is a toroidal revolving element in which tobacco can be combusted and with there being a passageway formed from the individual combustion chamber into the interior of the cylinder.

SUMMARY OF THE INVENTION

Apparatus for tobacco smoking comprising an elongated, upright, hollow cylinder having one end closed by a support base and the other end opened to enable it to be covered by one's mouth. A revolving member in the form of an annulus is axially aligned with the longitudinal axis of the cylinder, and telescopingly received by a medial portion of the cylinder, so that the member can be revolved respective to the cylinder.

A plurality of radially spaced combustion chambers are arranged within the revolving member in spaced relationship respective to the cylinder so that tobacco can be charged into each of the combustion chambers.

Each combustion chamber includes an inlet which enables tobacco to be placed therewithin and an outlet which enables smoke to flow therefrom.

A passageway extends from the interior of the cylinder into communication with the outlet of the chamber so that when tobacco is placed within a combustion chamber and ignited, air flows through the inlet of the chamber where it is available to burn the tobacco so that smoke can be drawn through the outlet, into the passageway, into the interior of the cylinder, and into one's mouth.

Accordingly, the primary object of the present invention is the provision of a sanitary and healthy means for smoking.

Another object of the invention is the provision of smoking apparatus having a contaminant trap and a cooling cylinder.

A further object of this invention is the provision of improvements in apparatus for smoking tobacco which is less hazardous to one's health as compared to pipes, cigars, and cigarettes.

A still further object of this invention is the provision of smoking apparatus which contains a plurality of charges of tobacco in a manner to permit each of the charges to be sequentially ignited.

Another and still further object of this invention is the improvements in community smoking apparatus.

The above objects are attained in accordance with the present invention by the provision of a combination of elements which are fabricated in a manner substantially as described in the above abstract and summary.

These and various other objects and advantages of the invention will become readily apparent to those skilled in the art upon reading the following detailed description and claims and by referring to the accompanying drawings.

DETAILED DESCRIPTION OF THE PREFERRED EMBODIMENTS

Figure 1:
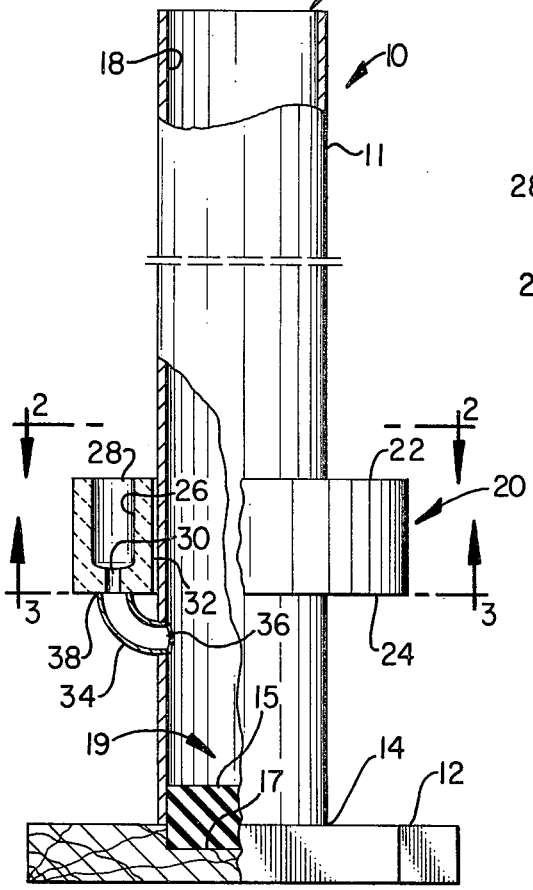
FIG. 1 is an elevational view of an apparatus made in accordance with the present invention, with some parts thereof being removed and some of the remaining parts thereof being disclosed in cross-section.

FIG. 1 discloses a water pipe or bong, generally indicated by the numeral 10, for smoking tobacco-like products. The apparatus includes an elongated, upright, hollow cylinder 11 attached to a base 12 in the indicated manner of numeral 14. A rubber stopper 15 is received in attached relationship within cavity 17 of the base while the inside diameter 18 is sealingly received about the outside diameter of the rubber stopper.

Open end 16 is spaced from lower chamber 19. A revolving member 20 in the form of a toroid or doughnut is concentrically arranged about the medial length of the hollow cylinder. The revolving member is rotatable respective to the upright, hollow cylinder and includes the illustrated upper face 22 opposed to a lower face 24. A plurality of radially spaced combustion chambers 26 are arranged about the revolving member. The chambers include inlet 28 so that tobacco can be charged therewithin and outlet 30 so that smoke can be withdrawn therefrom. The inside circumferentially extending wall 32 telescopingly receives medial portion of the upright, hollow cylinder therethrough with the tolerance between the inside diameter of the revolving member and the outside diameter of the upright hollow cylinder being sufficient to enable unrestricted motion therebetween.

Figure 2:
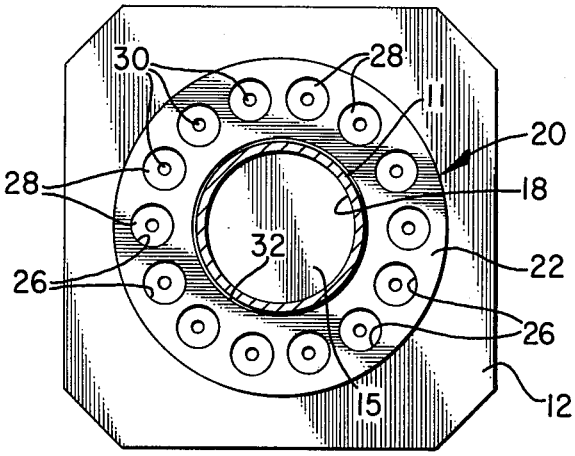
FIG. 2 is a cross-sectional view taken along line 2—2 of FIG. 1.
Figure 3:
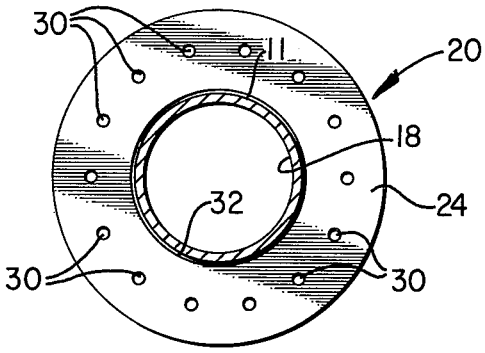
FIG. 3 is a cross-sectional view taken along line 3—3 of FIG. 1.

A smoke conducting passageway 34 in the form of an elbow conducts flow of smoke from one of the outlets 30 into the interior of the upright, hollow cylinder at 36. The passageway in the embodiment of FIGS. 1-3 is in the form of a curved hollow tube having one end rigidly affixed to the cylinder wall and the other end brought into supporting engagement respective to the lower face 24. The tolerance between the lower face 24 and the upper free end of tube 34 is such that a substantially sealed interface exists at 38 so that suction applied by one's mouth at 16 causes air to enter the upper end of the chamber at 28, with there being insignificant leakage of air into the system at interface 38.

In one form of the invention, the upright, hollow cylinder was fabricated from a 15 inch length of thin wall aluminum tubing $1\frac{1}{8}$ inch inside diameter, with the walls being about 1/32 inch in thickness, and with the revolving member having fourteen combustion chambers $\frac{1}{4}$ inch in diameter at the inlet and 3/32 inch diameter outlet 30, with the overall diameter of the revolver being $2\frac{1}{4}$ inches and $\frac{3}{4}$ inch in thickness.

Figure 4:
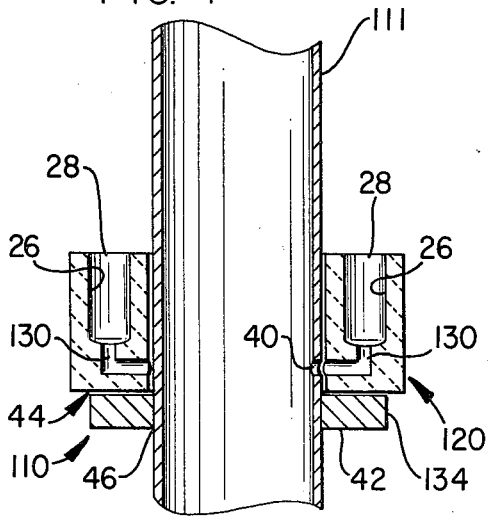
FIG. 4 is a fragmented, longitudinal cross-sectional view of a modification of the apparatus disclosed in FIGS. 1-3; and, FIG. 5 is a fragmented, longitudinal cross-sectional view of a modification of the apparatus disclosed in FIGS. 1-3 and 4.

In the embodiment of FIG. 4 the revolving member 120 is provided with outlets 130 which are aligned in indexed relationship respective to a radial port 40 formed within a sidewall of the upright, hollow cylinder. Stop means 42 is affixed to the outer wall surface of the cylinder and bottom supports the lower face of the revolving member as indicated by the arrow at numeral 44. The stop member 42 preferably extends about the entire circumference of the hollow cylinder and is rigidly affixed at 46 thereto by epoxy or the like.

Figure 5:
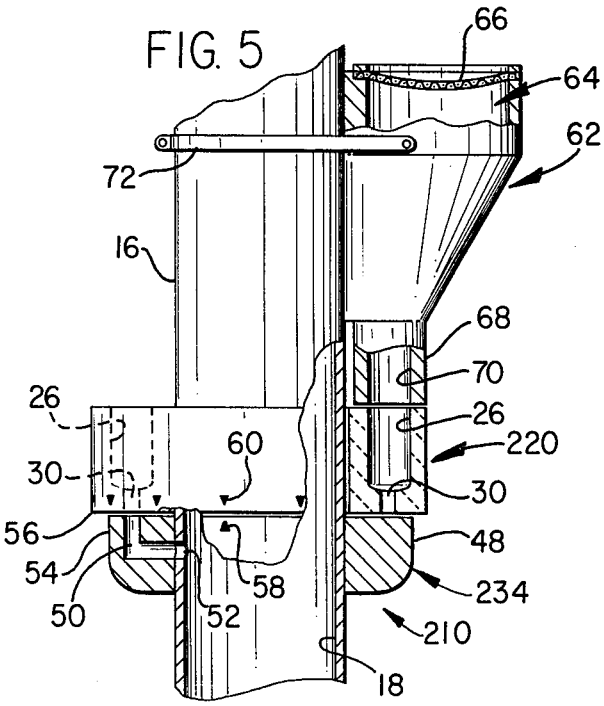

In the embodiment of FIG. 5 member 234 is rigidly affixed to the external wall of the hollow cylinder with the outside diameter 48 thereof being slightly less than the outside diameter of the revolving member 220. Passageway 50 is aligned with passageway 52 formed within a sidewall of the hollow cylinder and can be brought into alignment with passageway 30 of the revolving member. The upper face 54 of the stationary member 234 abuttingly engages the lower face 56 of the revolving member, thereby bottom supporting the revolving member and at the same time forming a passageway 50 which can be indexed with port 52 and passageway 30 of one of the combustion chambers thereof.

Indicia 58 and 60, when aligned in the illustrated manner of FIG. 5, indicate that passageways 30 and 50 are aligned with one another and with port 52.

Upwardly opening hopper 62 forms an enclosure 64 within which tobacco can be stored until needed. The position of the hopper relative to the revolving cylinder enables tobacco to be forced through the illustrated coarse mesh screen 66 so that smoking material can be subsequently forced into the cylindrical combustion chambers 26. The lower end of the hopper converges into a lower tubular element 68 which has an internal passageway 70 brought into alignment with one of the combustion chambers 26.

In operation each chamber 28 is sequentially filled with tobacco, outlet 30 is brought into registry with intake end 38 of elbow pipe 34, and the tobacco contained within the indexed chamber ignited. One's mouth is placed over the mouth end 16 and a suction effected within the cylinder, thereby causing ambient air to flow into inlet 28 due to the pressure differential effected thereacross. As air flows into chamber 26, partial combustion of the tobacco occurs and as the tobacco burns, smoke is formed as a result of the combustion reaction. The smoke therefrom is sucked through outlet 30, into the inlet end 38 of the tube 34, and into the hollow cylinder at 36. As the smoke flows up the tubing and towards one's mouth at 16, it contacts the inside peripheral wall surface of the hollow cylinder, and therefore is consequently substantially cooled because of the heat transfer mechanism involved herein, while at the same time any debris entrained therewithin falls to the bottom 19. A substantial amount of the heat contained within the smoke is also transferred into the hollow tubing 34 and thence into the heat sink formed by the hollow cylinder 11. Accordingly, substantial atmospheric cooling is effected on both the hollow tubing 34 and hollow cylinder 11. Where deemed desireable, water can be placed within the lower chamber 19, thereby increasing the heat sink properties of the apparatus as well as providing a washing action of any of the ash-like debris which fall out of the smoke.

In the embodiment of FIG. 4 a single port 40 is indexed with passageway 130 so that smoke from the combustion chamber 26 is drawn through passageway 130, through port 40, and into the interior of the cylinder chamber 111. Indicia can be placed on the revolving cylinder and on the stop 42 to indicate the relative position of the port 40 respective to one of the ports 130.

In the embodiment of FIG. 5, the lower stop means 234 is rigidly affixed to the hollow cylinder so that passageway 30 can be brought into aligned relationship respective to passageway 50. When indicia 60 and 58 are aligned with one another, the outlet passageway 30 is placed in communication with the inlet passageway 50. Where deemed desirable, a spring loaded ball and detent can be included either between the revolving member and the hollow cylinder, or between the stop member and the revolving member so that the outlet 30 is releasably held in alignment with the port 50.

Tobacco is placed within chamber 64 by placing a small quantity of smoking material upon screen 66, and rubbing the material with one's thumb, thereby forcing the material through the screen so that the preferred particle size of tobacco is stored within the hopper. The screen 66 can be removed and a pencil or other punch-like apparatus used to force the tobacco through the tube 70 and into the combustion chambers. The hopper 62 preferably is placed 180° respective to the passageway 50 so that there is no danger of igniting the tobacco contained within the hopper.

I claim:

1. An apparatus for smoking tobacco comprising:

an upright member having a chamber formed therewithin, an outlet for said chamber which can be covered by one's mouth;

a revolver member, means forming an aperture through said revolver member through which a marginal length of said upright member can be received, means rotatably supporting said revolver member about a marginal length of said upright member;

means forming a plurality of radially spaced-apart combustion chambers in said revolver member within which tobacco can be placed, means forming an inlet and an outlet for each said combustion chamber, means forming a flow passageway which extends from said outlet of said combustion chamber into communication with the interior of said chamber of said upright member; said revolver, when rotated, sequentially indexes the outlet of a combustion chamber with said flow passageway;

whereby tobacco can be placed within the combustion chambers, the outlet of one of the chambers indexed with said flow passageway, the tobacco within the indexed chamber ignited, one's mouth placed on the outlet for said chamber of said upright member to thereby force smoke to flow from the combustion chamber containing the burning tobacco, through the flow passageway, into the chamber of the upright member, and into one's mouth;

and thereafter the revolver can be rotated to bring another of the tobacco filled combustion chambers into indexed relationship respective to the flow passageway, so that tobacco in the last said another of said combustion chambers can be ignited and smoked.

2. The apparatus of claim 1 wherein said upright member is an elongated hollow cylinder, said revolver is an annular member which is concentrically arranged about said hollow cylinder with said radially spaced combustion chambers being arranged in radially spaced relationship respective to said hollow cylinder.

3. The apparatus of claim 2 wherein said means forming a flow passageway from said revolver member is a hollow elbow, said elbow has one end thereof affixed to said hollow cylinder with the other end thereof supportingly and sealingly engaging said revolver member in a slidably manner therewith.

4. The apparatus of claim 2 wherein said means forming a flow passageway is an annular support member underlying said revolver member and affixed to said elongated hollow cylinder, with said annular support member, revolver member, and hollow cylinder being concentrically aligned with one another;

said flow passageway extends from the interior of said hollow member, into said annular support member, so that the outlet of a combustion chamber can be aligned therewith.

5. The apparatus of claim 4 wherein means forming indicia is provided on said apparatus to indicate alignment of said combustion chamber outlet with said flow passageway.

6. Smoking apparatus comprising:

a base, an elongated, upright hollow cylinder having one end affixed to said base and the other end open to enable smoke to exit therefrom;

a revolving member in the form of an annulus, means by which said revolving member is concentrically arranged in supported relationship respective to a medial length of said hollow cylinder and rotatable about the longitudinal axis of said hollow cylinder; means forming a plurality of radially spaced combustion chambers within said revolving member within which tobacco can be stored and subsequently combusted; each said combustion chamber having an inlet and an outlet;

means forming a flow passageway which selectively extends from the outlet of one said combustion chamber and into the interior of said hollow cylinder;

so that tobacco can be placed in each of said combustion chambers, the tobacco in one said combustion chamber ignited, and smoke from the burning tobacco drawn through said flow passageway, into the interior of said cylinder, and into one's mouth.

7. The smoking apparatus of claim 6 wherein said flow passageway includes a port formed in the wall of the cylinder; a passageway formed from each said outlet of each said combustion chamber which extends through said revolving member and terminates adjacent to said wall of said cylinder;

the termination of the last recited passageway being positioned respective to the port such that rotation of the revolving member causes said termination of the passageways to be sequentially aligned with the port so that each combustion chamber can be selectively flow connected to the interior of the hollow cylinder.

* * * * *